US009944440B2

(12) United States Patent
Abraham

(10) Patent No.: US 9,944,440 B2
(45) **Date of Patent: *Apr. 17, 2018**

(54) VENTED CONTAINER CLOSURE

(71) Applicant: Greif International Holding BV, Vreeland (NL)

(72) Inventor: Pierre Abraham, Le Grand-Quevilly (FR)

(73) Assignee: GREIF INTERNATIONAL HOLDING B.V., Vreeland (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/261,975

(22) Filed: Sep. 11, 2016

(65) Prior Publication Data

US 2016/0376076 A1 Dec. 29, 2016

Related U.S. Application Data

(62) Division of application No. 13/988,490, filed as application No. PCT/EP2011/070503 on Nov. 18, 2011.

(30) Foreign Application Priority Data

Nov. 22, 2010 (GB) ..... 1019769.7

(51) Int. Cl.
*B65D 51/16* (2006.01)
*B65D 41/04* (2006.01)
*B65D 53/04* (2006.01)

(52) U.S. Cl.
CPC ..... *B65D 51/1622* (2013.01); *B65D 41/045* (2013.01); *B65D 41/0442* (2013.01); *B65D 51/1616* (2013.01); *B65D 51/1666* (2013.01); *B65D 51/1694* (2013.01); *B65D 53/04* (2013.01); *B65D 2205/00* (2013.01); (Continued)

(58) Field of Classification Search
CPC ..... B65D 51/16; B65D 51/1688; B65D 51/1622; B65D 41/0442; B65D 41/045; B65D 51/1616; B65D 51/1666; B65D 51/1694; B65D 53/04; B65D 2205/00; (Continued)

(56) References Cited

U.S. PATENT DOCUMENTS 2,804,225 A 8/1957 Lee
2,965,257 A 12/1960 Lipman
(Continued)

*Primary Examiner* — J. Gregory Pickett
*Assistant Examiner* — Gideon Weinerth
(74) *Attorney, Agent, or Firm* — Baker & Hostetler LLP

(57) ABSTRACT

A container closure comprises an annular region forming a counterface against which a gas permeable, liquid impermeable sealing element may be applied so as to urge the sealing element into sealing engagement with the rim of a container opening. The annular region comprises a gas pathway from an interior space opposite the container opening to the exterior of the annular region. The gas pathway may be of closed cross-section extending through the annular region. Alternatively the gas pathway may be of open-sided cross-section and provided in the counterface. Yet alternatively the annular region may comprise a washer, with the gas pathway provided at least partly in the washer and/or at least partly in the remainder of the annular region. A gas permeable, liquid impermeable sealing foil for bonding to a container rim is also disclosed.

34 Claims, 9 Drawing Sheets

(52) U.S. Cl.
CPC .. *B65D 2205/02* (2013.01); *B65D 2251/0015* (2013.01); *B65D 2251/0093* (2013.01)

(58) Field of Classification Search
CPC ..... B65D 2205/02; Y10T 428/214; Y10T 428/218; Y10T 428/215
USPC ..... 215/307, 350, 341, 342, 345, 363, 902; 220/373, 367.1
See application file for complete search history.

(56) References Cited

U.S. PATENT DOCUMENTS 2,980,276 A * 4/1961 Robineau ..... B65D 41/0435 215/260
3,114,467 A 12/1963 Montgomery
3,174,641 A * 3/1965 Kitterman ..... B65D 41/045 215/260
3,428,208 A * 2/1969 Kosar ..... B65D 41/0428 215/341
3,448,882 A 6/1969 Roy et al.
3,589,545 A 6/1971 Carpenter
3,628,704 A * 12/1971 Corsette ..... B65D 51/1661 215/260
3,815,314 A 6/1974 Pollock et al.
4,036,386 A 7/1977 Nishioka et al.
4,209,126 A 6/1980 Elias
4,372,460 A 2/1983 Brochman et al.
4,427,126 A * 1/1984 Ostrowsky ..... B65D 41/045 215/307
4,765,499 A 8/1988 von Reis et al.
4,789,074 A * 12/1988 Han ..... B65D 53/04 215/230
4,858,758 A 8/1989 Mitchell et al.
5,004,111 A 4/1991 McCarthy
5,176,271 A 1/1993 Painchaud et al.
5,183,171 A 2/1993 Pherigo
5,328,063 A * 7/1994 Beck ..... B65D 51/1644 222/524
5,494,200 A 2/1996 Sheffler et al.
5,551,608 A 9/1996 Moore et al.
5,579,936 A 12/1996 Costa et al.
5,637,396 A 6/1997 Sato et al.
5,730,306 A 3/1998 Costa et al.
5,862,928 A * 1/1999 Breuer ..... B65D 53/04 215/341
5,871,112 A * 2/1999 Giles ..... B32B 5/18 215/347
6,202,870 B1 3/2001 Pearce
6,202,871 B1 3/2001 Kelly
6,502,710 B1 1/2003 Bosl et al.
6,581,793 B1 * 6/2003 Racine ..... B65D 41/045 215/252
6,783,015 B1 * 8/2004 Bosl ..... B65D 41/045 215/307
6,857,561 B2 2/2005 Williams et al.
6,983,857 B2 * 1/2006 Miller ..... B65D 51/165 215/270
7,461,754 B2 * 12/2008 Walsh ..... B65D 51/1616 215/261
2002/0014057 A1 2/2002 Vizulis et al.
2002/0144971 A1 * 10/2002 Nilstoft ..... B65D 41/045 215/350
2004/0055992 A1 * 3/2004 Robinson ..... B65D 1/023 215/347
2004/0262253 A1 12/2004 Miller et al.
2005/0284837 A1 12/2005 Taber et al.
2011/0186536 A1 * 8/2011 Wurster ..... B65D 79/005 215/307
2012/0285965 A1 * 11/2012 Ekkert ..... B65D 43/0231 220/304
2015/0083727 A1 * 3/2015 Smolko ..... B65D 23/12 220/373

* cited by examiner

VENTED CONTAINER CLOSURE

CROSS-REFERENCE TO RELATED APPLICATIONS

This application is a divisional of U.S. patent application Ser. No. 13/988,490, filed May 20, 2013, and published as U.S. Patent App. Pub. No. 2013/0240531 on Sep. 19, 2013, which is a National Stage of International Patent App. No. PCT/EP2011/070503, filed Nov. 18, 2011, which claims priority to Great Britain Patent App. No. GB 1019769.7, filed Nov. 22, 2010, the disclosures of which are incorporated by reference in their entirety.

FIELD OF THE INVENTION

This invention relates to a container closure, in particular such a closure which allows for venting in a container-closure combination.

BACKGROUND

A known type of container-closure combination is a cap having a non-gas tight screw thread fitting with a complementary threaded neck of a container and a sealing element in the cap to form a gas- and liquid-tight seal with the container neck. Such a combination is illustrated by Document CH-A-357330. Liquid containers can become over or under pressurised and the container damaged, such as by ballooning or crushing, depending on the liquid to be contained and the ambient temperatures. One solution is to make the container strong enough to resist such changes. Another solution is to fit the container with a gas vent. The choice of solution is mainly an economic one, depending upon whether or not it is cheaper to make the container stronger or to fit a gas vent, although sometimes environmental considerations are a factor.

Document WO-A-95/26913 discloses a cap lining for bi-directional venting from the interior of a container to the ambient atmosphere through openings existing between the spiral screw threads of the cap closure and threads of the container neck. The only seal disclosed between the cap and the container is that provided by compression of the cap lining plies. Such special multilayer cap linings are however quite expensive to manufacture. An alternative is to provide a hole in a central region of an otherwise standard cap sealing wad over which a gas permeable, liquid impermeable membrane is secured. A further hole is formed in the centre of the cap top wall, in gas communication with the wad hole and membrane, thereby providing a gas venting route. However the exposed hole in the top of the cap is vulnerable to dirt and other contaminants. These can clog the membrane and inhibit proper venting or penetrate the membrane and contaminate the container contents, unless further protective structures are provided in the wad and/or cap top surface. The exposed hole in the top of the cap also makes the membrane vulnerable to mechanical damage. There is therefore a need for a cheap, robust, versatile and reliable container venting arrangement which preferably requires minimal modifications to the container closure and/or sealing wad.

SUMMARY OF THE DESCRIPTION

According to the present invention, there is provided a container closure comprising an annular region forming a counterface against which a gas permeable, liquid impermeable sealing element may be applied so as to urge the sealing element into sealing engagement with the rim of a container opening, characterised in that the annular region comprises a gas pathway, e.g. a through hole or surface groove, connecting (i) a space within the container closure which is covered by the applied sealing element, and (ii) the exterior of the annular region. When the pressure in the container rises above ambient, gas may pass out of the container opening, through the sealing element, into the interior space, through the gas pathway formed in the annular region, and from there to ambient. Similarly, when the container is under pressurised with respect to ambient, gas may flow along the same route in the opposite direction, into the container.

Where the container closure is round, e.g. a screw cap, snap-fit cap, crown cap or the like fitted to a round container neck, the annular region may be circular. However, where the container opening is non-circular, e.g. square, rectangular or other polygonal, the annular region may be similarly non-circular, e.g. polygonal. The screw thread, snap fitting, crimped retaining rim, or similar means for securing the closure on the container may be situated between the annular region and ambient, across the pressure equalisation or venting route. In that case the closure securing means is ensured to be (if necessary deliberately made) non-gas tight, so as to complete the above-described gas flow route between the container interior and ambient. This allows gas venting and pressure equalisation to take place. A screw threaded closure securing means such as on a screw cap and threaded neck is particularly advantageous, in that it provides a labyrinthine flow pathway for the pressure equalising gas flow, which may help to preclude dirt or similar contaminants from reaching the container interior, particularly the sealing element. However, other forms of closure retaining means can also serve this function (e.g. a snap fit or crimped closure such as a crown cap). The gas pathway through the annular area can also be labyrinthine or reticulated to help exclude solid contaminants.

The gas permeable, liquid impermeable sealing element acts to retain liquid in the container, whilst allowing gas to leave or enter the container, thereby providing venting and pressure equalisation with respect to ambient. During transport and storage of the container, the container opening and attached closure are normally oriented at or towards the highest point on the container, so that they are placed in communication with a gas filled head space in the container so that venting can take place. This also places less demand on the liquid containing capabilities of the sealing element and closure.

A transverse cross-section of the gas pathway through the annular region may comprise a closed boundary and may extend from the interior space opposite the container opening to the exterior of the annular region. However such closed boundary pathways may be difficult to form, e.g. by injection moulding, in the case of an injection moulded plastics closure such as a container cap. The annular region may therefore comprise a separately formed washer on which the counterface is located, the washer and/or an opposing surface in the remainder of the annular region containing parts of a through hole having an open-sided transverse cross-section, e.g. a channel-shaped through hole part, forming part of the gas passageway. The cross-section of this through hole part may or may not be closed by the co-operating one of the opposing surface or washer, whichever the case may be.

However in a particularly advantageous development of the invention it has been found that the gas pathway through the annular region may be of open-sided transverse cross-section and provided in the counterface. With such an arrangement a separately formed washer on which to locate the counterface is unnecessary. Surprisingly, it has been found that by proper selection of:

(i) the thickness and elasticity of the sealing element, in particular those regions of it situated between the rim of the container and the counterface, (ii) the cross-sectional form and dimensions of the gas pathway, and, where there are several separate gas pathways, their distribution about the annular region, and (iii) the degree to which the sealing element is compressed between the counterface and the container opening rim, a deliberately "bad" or "leaky" gas seal can be produced at the interface between the sealing element and the counterface, due to the unevenness in the counterface arising from the presence of the open cross-sectioned through hole(s). This provides the required gas pathway from the interior space to the exterior of the annular region. At the same time, a good, liquid tight, seal can be produced at the interface between the rim of the container opening and the sealing element. Variations in pressure on and deformation of the counterface side of the sealing element are taken up and attenuated through the thickness of the sealing element, so that the pressure at the container opening rim side of the sealing element is sufficiently uniform to provide a liquid tight seal. Obtaining a liquid tight seal is in any event usually less onerous than obtaining a gas tight seal, as gases are generally more mobile than liquids. It does not matter if there is gas leakage at the container opening rim/sealing element interface (without significant liquid leakage), as this merely contributes to the required gas venting.

The through hole(s) or open sided channels forming the gas pathway through the annular region may be unbranched, branched, or reticulated. Where the through holes have an open cross-section, a series of them may be provided which together define a series of ridges and hollows in the counterface or (where the washer is present) also elsewhere in the washer or in the face of the annular region opposing the washer. The transverse cross-sectional profile of the series may be, inter alia, wave shaped (e.g. approximately sinusoidal), or saw-toothed, symmetrical or asymmetrical, with or without flattened teeth tip regions or flattened bases to the hollows.

The interior space in the container closure opposite to the container opening may comprise one or more spacing supports, e.g. protruding from a top wall of the container closure, and which can support the sealing element so as to define gaps in gas communication with the gas pathway in the annular region. The spacing supports prevent the sealing element from collapsing against the top wall and restricting gas flow between the container opening and the annular region. The annular region may be provided at or towards the outer edge of the top wall. The sealing element may be clipped, glued, tack welded or otherwise securable in place inside the container closure, to cover the annular region and interior space. For example the container closure may comprise a side wall with a peripheral groove or a series of undercut protuberances forming notches into which the outer edge of the sealing element can be clipped.

The gas permeable, liquid impermeable sealing element may additionally or alternatively be bonded to the container about the rim of the container opening, to form a tear-off part. This is advantageous in its own right, in providing an anti-tamper feature, helping to assure the integrity of the container contents, independent of the route for the gas pressure equalisation flow. Such a rim bonded sealing element may be used together with any suitable form of container closure including, for example, caps having vent holes in their tops. However the particular protective and anti-contamination advantages described above arise if the rim bonded sealing element is used in conjunction with a cap providing a gas venting route through the annular area above the container opening rim and sealing element, as also described above. Accordingly, in a second independent aspect, the present invention provides a container closure comprising a gas permeable, liquid impermeable sealing element bonded about the rim of a container opening, to form a tear-open part.

Conveniently, the sealing element may comprise an induction heatable foil (e.g. a metallic or metallised foil) weldable to the container opening rim; although any suitable form of rim bonding, including adhesives, can be used.

The sealing element may further comprise an aperture over which a gas-permeable, liquid impermeable layer is secured, for example a gas-permeable, liquid impermeable membrane or gauze, secured for example by bonding around the edges of the aperture. Again, any suitable form of bonding can be used to secure the membrane or gauze to the remainder of the sealing element.

Once the tear-open part has been ruptured or removed to access and/or dispense the container contents, it cannot be used to re-seal the container. Preferably the sealing element therefore comprises a further part which remains in the container closure when the tear-open part has been ruptured or removed. In a particularly preferred arrangement the further part is also gas-permeable and liquid impermeable and arranged in the closure so as to be in gas communication with the tear-open part prior to its removal. The sealing element therefore acts as a "multi-use" container seal, with the further part providing gas-venting and liquid sealing capabilities to the container closure after removal of the tear-open part.

Conveniently, the further part is connectable to the container closure and the tear-open part is connectable to the further part, with the strength of the connection between the further part and closure and the strength of the bond between the tear-open part and container opening rim being greater than the strength of the connection between the tear-open and further parts. Thus the sealing element may be applied to the closure as a unitary assembly securable to the closure via the further part. The closure may then be applied to the container opening and the tear-open part bonded to the container opening rim. Upon removing the container closure for the first time, the connection between the tear-open and further parts is broken, leaving the tear-open part exposed for rupture or removal from the container opening and leaving the further part retained in the closure. The closure and further part of the sealing element can then be re-applied to the container opening to serve their liquid sealing and gas venting functions even after the tear-off part of the sealing element has been breached.

To assist in its removal, the tear-open part may be provided with an "Easy Peel"® or similar tab forming a finger grip.

Correspondingly, in a related but further independent aspect, the present invention provides a sealing element for a container closure, comprising a sealing foil of predetermined shape for peripheral bonding about a container rim of corresponding shape, in which the sealing foil is gas permeable and liquid impermeable. The sealing element may comprise a further gas permeable, liquid impermeable part of similar shape to, and in gas communication with, the sealing foil. The further part may be secured to the sealing foil by a breakable connection. The sealing foil may be provided with a tab forming a finger grip.

BRIEF DESCRIPTION OF THE DRAWINGS

Further preferred features and non-limitative details of the invention may be understood from the following description of illustrative embodiments, made with reference to the drawings, in which.

DETAILED DESCRIPTION

Figure 1:
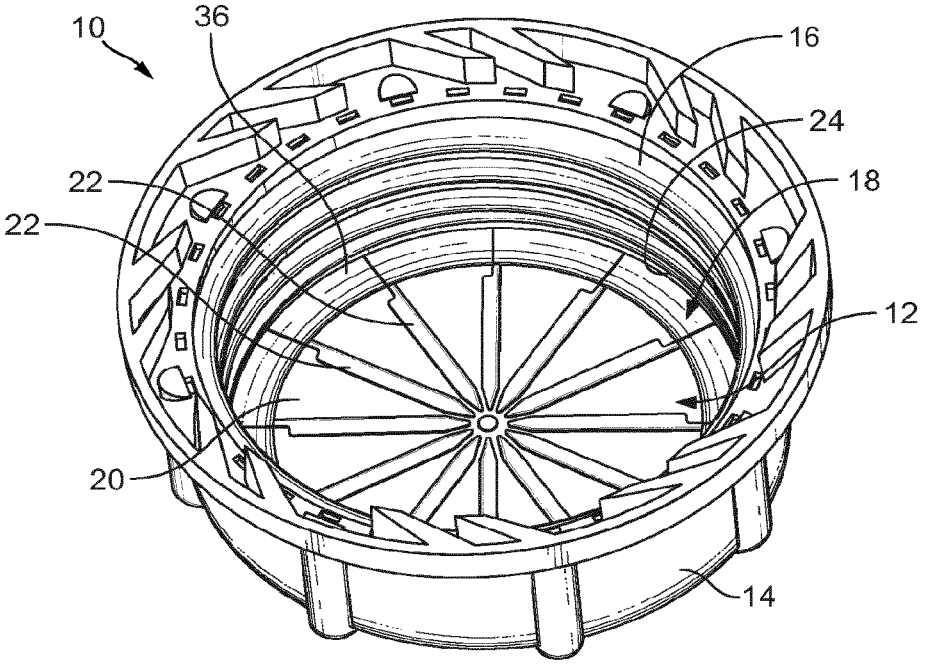
FIG. 1 is a perspective view of the interior of a container screw cap which embodies the present invention, shown prior to fitment of the sealing element.

The container closure 10 shown in FIG. 1 is a screw cap which comprises a generally flat top wall 12 and a generally cylindrical side wall 14. A screw thread 16 is formed on the inside of the side wall 14. The cap may be injection moulded from plastics material. Immediately inward of the side wall, the top wall has an annular region 18 which cooperates with a container neck (not shown) to compress the outer edge part of a gas permeable, liquid impermeable sealing element into sealing engagement with the rim of the container opening (not shown). The annular region 18 is provided with a pathway, e.g. any suitable form of through hole or channel, or several such through holes/channels, allowing bi-directional gas flow between an interior space 20 and the labyrinthine gap formed by the interengaging cap threads 16 and container neck threads. Various examples of such through holes/channels/gas pathways are further described later. Other means for securing the closure 10 on the container may be used in place of the threaded side wall 14, e.g. a snap-fit or crimped rim. In such cases the closure and container opening need not be circular. In each case the securing means does not form a gas tight seal with the container neck, so as to allow gas venting and pressure equalisation as further described below.

The interior space 20 is situated inward of the annular region 18 and is also bounded by the top wall 12 and the sealing element when fitted. The interior space 20 therefore lies opposite to the container opening, above the central area of the sealing element. Spacing supports which as shown in FIG. 1 take the form of radial ribs 22 are provided to prevent the central area of the sealing element inward of the annular region 18 from collapsing against the top wall 12. The sealing element is therefore kept spaced from the top wall 12 to form the interior space 20. Gas passing through the sealing element can therefore flow to or from the annular region 18 in a direction generally parallel to the top wall 12. Any other suitable form of spacing support may be used which permits such gas flow, e.g. a concentric series of interrupted annular ribs, in which the interruptions provide gaps for the gas flow, or an array of spacer "pips", in which the gaps between the pips form a reticulated gas flow space. The spacing supports not only serve to maintain the interior space 20, but also strengthen and protect the sealing element against bursting, e.g. absorbing stresses on the sealing element caused by sudden pressure changes, resulting from the container being dropped or knocked.

Instead of protruding from the top wall 12, the spacing supports may be formed on or attached to the sealing element or the optional washer, each of which are further described below. Yet alternatively, either or both of the annular region 18 and the spacing supports may be formed on a separate insert fitted into the cap adjacent to the top wall 12. The sealing element may be glued or tack welded to the ribs 22 or other spacing supports depending from the top wall 12 (or washer or insert, where present) to retain it in the closure 10. Additionally or alternatively, the rim of the sealing element may be clipped into position by insertion into a retaining groove 24 provided circumferentially about the side wall 12 above and adjacent to the annular region 18. Yet alternatively the side wall 14 may carry a series of undercut protuberances (30, FIG. 3) spaced about its circumference. The undercuts form notches into which the rim of the sealing element can be clipped to retain the sealing element in the closure 10. The rim of the sealing element lies next to the side wall 12 (including the retaining groove 24, where present) sufficiently loosely so that a gap exists for gas flow around the rim, as further described below.

Figure 2:
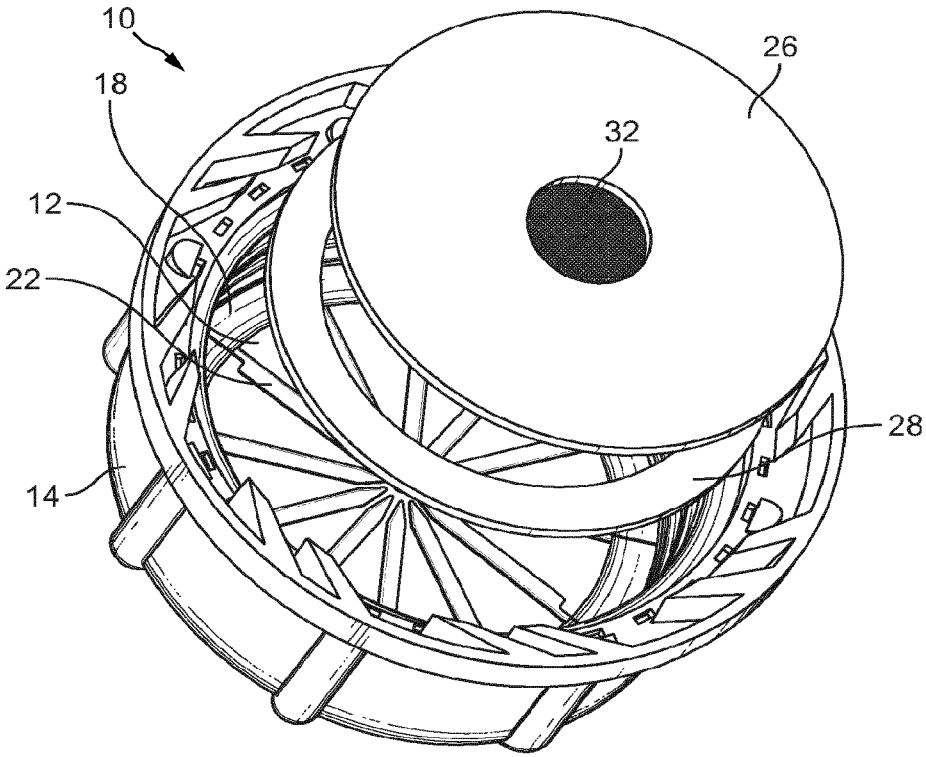
FIG. 2 is an exploded view showing an optional washer and the sealing element being assembled with the screw cap of FIG. 1.

FIG. 2 shows the sealing element 26 and optional washer 28 being fitted to the cap 10. The sealing element 26 may be any suitable gas permeable, liquid impermeable sealing element of per se known kind. As shown, it comprises a resilient disc e.g. of expanded polyethylene. This material is substantially liquid and gas impermeable. To confer gas permeability, a hole 32 is formed in a central part of the disc, over which a gas permeable, liquid impermeable gauze or laminate is sealingly secured continuously around its periphery, e.g. by gluing or welding. The gauze may be a microporous material such as GORE-TEX® or equivalent. The resiliency of the remainder of the disc ensures that it can form a liquid tight seal with the rim of the container opening when pressed against this by the annular region 18. The necessary pressure is generated by the cap being secured in place by the threaded wall 14 or alternative securing means, with the peripheral part of the sealing element held in compression between the annular area 18 and the rim of the container opening. The annular region 18 may comprise the optional washer 28, which is relatively undeformable and presents a substantially smooth counterface immediately adjacent to the sealing element 26, so that the latter is uniformly loaded and compressed against the rim of the container opening.

Figure 3:
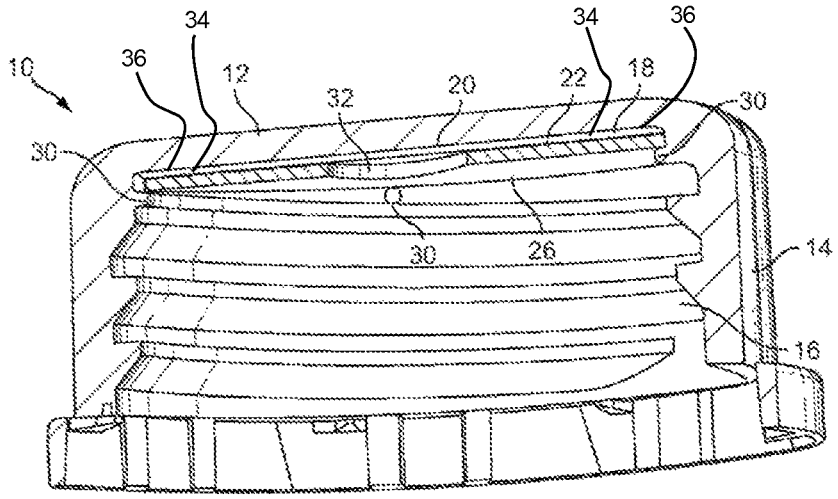
FIG. 3 is a cutaway view of the cap of the preceding Figures, with only the sealing element installed.
Figure 4:
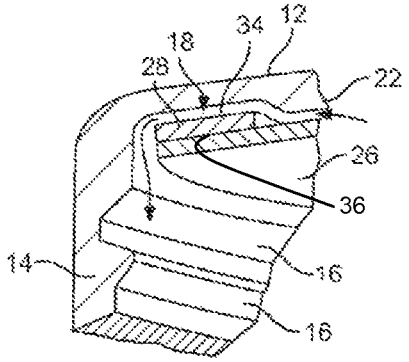
FIG. 4 is a scrap view corresponding to part of FIG. 3, but showing a variant in which the washer is also used.
Figure 4A:
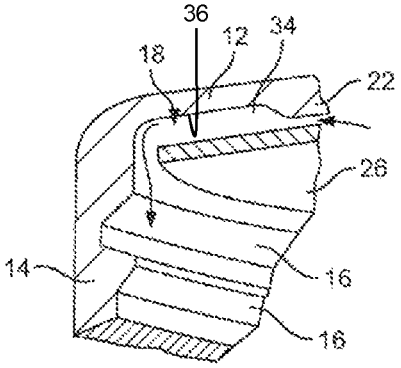
FIG. 4*a* corresponds to FIG. 4 with the washer omitted.

FIGS. 3 and 4*a* show the sealing element 26 installed in the cap 10 without using the washer 28. FIG. 4 shows the equivalent arrangement with the washer 28 in place. In both cases a through hole exists, extending through the annular region 18, forming a pathway 34 for gas to flow to and from the interior space 20 through to the mating threads of the cap and container neck (or equivalent closure securing arrangement) and through the gauze 32, as represented by the unreferenced arrows in FIGS. 4 and 4*a*. Gas may flow from the thread area (or equivalent closure securing arrangement) around the outer rim of the sealing element 26 through the gap next to the side wall 14 and through the through holes of the gas pathway 34; the latter communicating with the interior space 20. The arrows indicate the gas flowing outwardly so as to relieve overpressure in the container, but this flow may be reversed, to relieve underpressure.

Figure 4B:
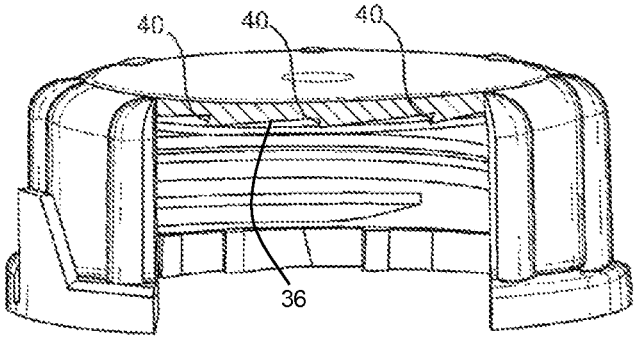
FIG. 4*b* is a partly cutaway side view corresponding to FIG. 3, showing the annular region and gas pathways.

FIG. 4*b* shows a preferred surface profile for the annular region 18, in which the ridges 40 take the form of an asymmetric saw-tooth shape. This surface shape may be used with a washer 28, but is preferably used without such a washer, to form gas pathways as described in more detail below and as diagrammatically shown in FIG. 8*a*. The cap 10 as shown has a DIN 60 thread (6 mm thread pitch) and there are twelve ridges 40 in the annular region 18, each ridge having a height of 0.5 mm. Other ridge configurations are equally feasible, e.g. eight ridges each 0.75 mm in height: see "Screw Cap Moulding Considerations", below. The ridge height and shape can be adapted to other closure sizes and types.

Figure 4C:
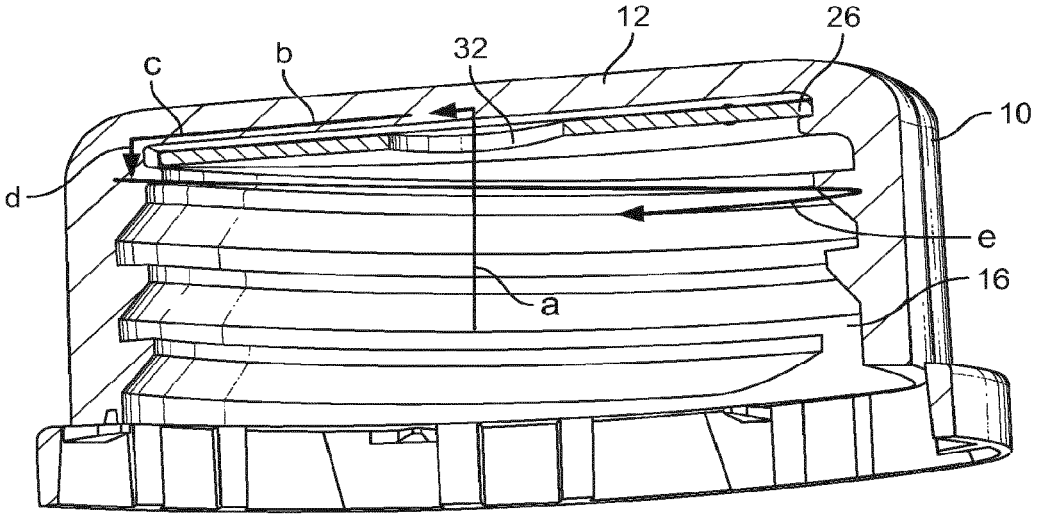
FIG. 4*c* corresponds to FIG. 3 and schematically indicates a venting gas flow route from container interior to closure securing threads.

In FIG. 4*c*, the complete gas flow route is indicated: a) from the container interior through the aperture 32 and its covering gas-permeable liquid-impermeable membrane (not shown); b) radially outwardly through the interior space defined between the underside of the cap 10 and the opposing surface of the sealing element, this gap being maintained by the spacing supports 22; c) radially through the gas pathway(s) provided in the annular region 18; d) around the outer edge of the sealing element 26 (thus there must be at lest a small gap between the outer edge of the sealing element and the adjacent cap side wall 14 at at least one point around their circumference, so as not to impede the gas flow significantly); e) and finally through the labyrinthine helicoidal path defined by the intermeshing threads on the inner surface of the cap side wall 14 and the outer surface of the container neck (not shown). See corresponding references a)-e) on the flow arrow shown in FIG. 4*c*. Of course, for equalisation of sub-ambient pressure in the container, the gas flow direction may be reversed.

Figure 5:
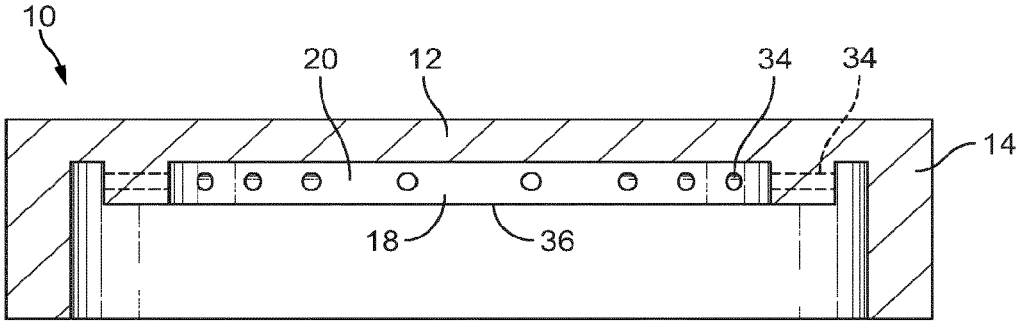
FIG. 5 is a diagrammatic cross-sectional view showing the annular region of a cap embodying the invention in which the gas pathway comprises through holes having a closed cross-section.

The annular region 18 and its gas pathway 34 may take various forms. As shown in FIG. 5, the annular region is ridge-like, having a generally uniform rectangular radial cross-section. This ridge presents a uniform, flat counterface 36 to the peripheral region of the sealing element 26, so as to uniformly press and compress the latter against the rim of the container opening. Through holes forming the gas pathway 34 have a closed transverse cross-section which does not intersect with or interrupt the counterface 36, and extend generally radially through the ridge-like annular region 18.

Figure 6:
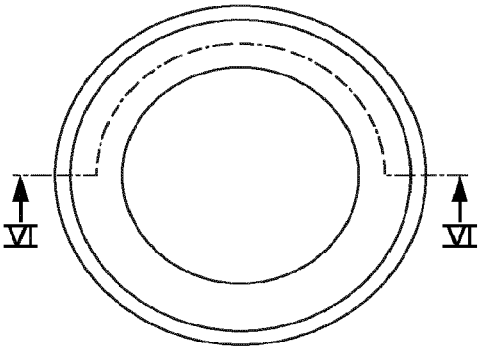
FIG. 6 is a diagrammatic plan view of a cap top wall as seen from inside the cap, including the annular region and showing a section line corresponding to FIGS. 6*a*-6*c*, 7 and 8*a*-8*f;*

FIGS. 6*a*-6*c*, 7 and 8*a*-8*f* are highly diagrammatic representations of alternative forms of the annular region 18 and gas pathway 34. The section line VI-VI for these figures is indicated in FIG. 6, and comprises a semi-cylindrical central part which is shown in the sectional views "unrolled" and flattened into the plane of the page. The closure side walls or other means 14 for securing the closure 10 over the container opening are nevertheless still shown diagrammatically in radial section.

Figure 6A:
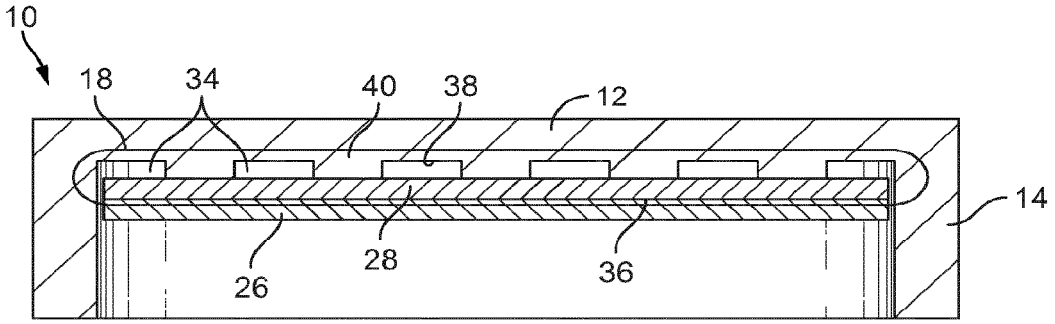
FIGS. 6*a*-6*c* are diagrammatic cross-sectional views showing different configurations of the annular region of the kind incorporating the washer.

In FIG. 6*a*, the annular region 18 comprises the washer 28, on which the counterface 36 is located. The remainder of the annular region at the periphery of and at the inside of the closure top surface 12 is formed with a series of radially extending grooves 38 defining and separated by radially extending ridges 40. The washer 28 is supported on the ridges 40 to close off the open cross-sections of the grooves 38 and form the gas path 34. Both the grooves 38 and the ridges 40 are shown in the drawing as having generally rectangular cross-sections, but any other suitable shape may be used. The generally flat counterface 36 of the washer again serves to uniformly load and compress the sealing element 26 against the rim of the container opening.

Figure 6B:
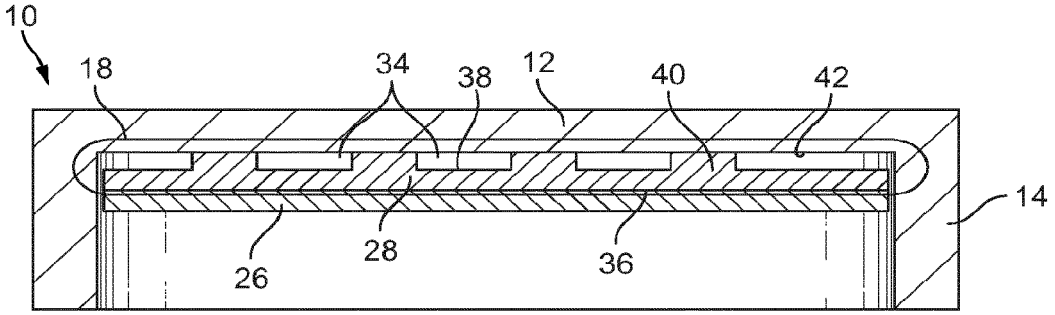

FIG. 6*b* is similar to FIG. 6*a*, except that in FIG. 6*b* the part of the annular region 18 formed on the closure top wall 12 has a generally flat surface 42 that faces the washer 28. The cooperating face of the washer opposite the counterface 36, rather than being generally flat, is provided with the radially extending grooves 38 and ridges 40. These grooves and ridges together with the flat surface 42 define the gas pathway 34. In other words, the grooves and ridges 38, 40 are provided in the washer 28, rather than in that part of the annular region 18 formed in the closure top surface 12.

Figure 6C:
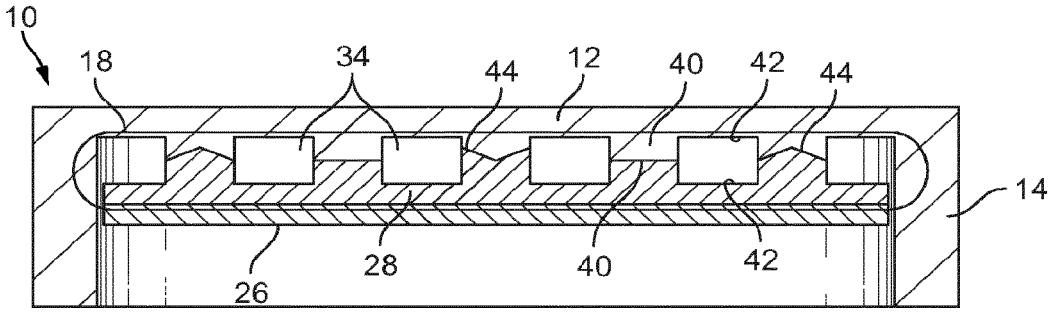

FIG. 6*c* is again similar to FIGS. 6*a* and 6*b*, except here the ridges 40 and grooves 42 are provided both in the washer and in the top surface part of the annular area, so that the through holes of the gas pathway 34 are provided partly in the closure top surface 12 and partly in the washer 28. Some or all of the ridges may comprise circumferential alignment and anti-rotation features 44.

Figure 7:
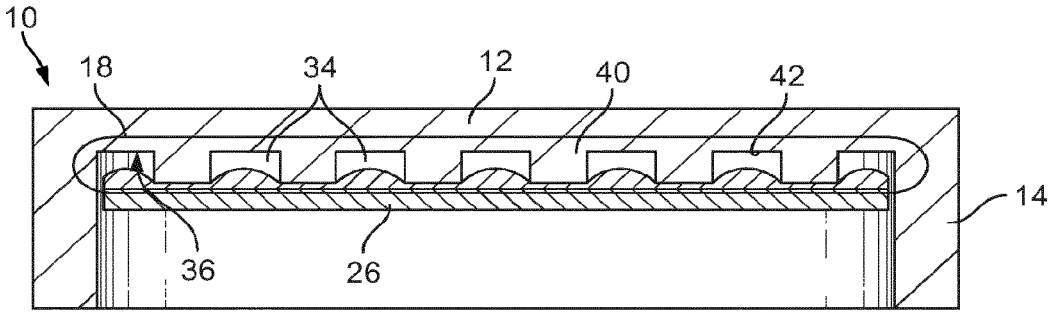
FIG. 7 corresponds to FIG. 6*a* but shows the annular region formed without use of a washer.

In FIG. 7, like in FIG. 6*a*, the ridges 40 and grooves 38 are provided in the closure top wall 12, but the washer is omitted. Thus the whole of the annular region 18 is provided at the periphery of and at the inside of the closure top wall 12. The exposed surface of the ridges and grooves therefore constitutes the counterface 36 of the annular region, this counterface therefore being uneven. The loading on and the deformation of the sealing element 26 at the counterface 36 is therefore also uneven when the closure 10 is secured over the container opening. Those parts of the sealing element opposite a ridge 40 are put under higher pressure and are more deformed than those parts of the sealing element opposite a groove 42. The resilience of the sealing element (in particular those parts of it cooperating with the annular region 18) and the shape of the grooves and ridges are selected so that under the loading (or possible range of loading) experienced when the closure is properly secured to the container opening (e.g. screwed on with a specified maximum torque), those parts of the sealing element opposite the grooves 42 do not fully occupy the grooves; or at least the pressure on the sealing element at the bottom of the grooves is low enough to form a gas leakage path, i.e. a through hole or gas pathway 34. At the same time, the thickness and stiffness of the sealing element are selected so that the uneven loading becomes sufficiently attenuated at the far side of the sealing element, remote from the counterface 36, so as to form a complete liquid-tight seal around its entire periphery, against the rim of the container opening. The shape of the counterface 36 and the thickness and resiliency of the cooperating part of the sealing element 26 under particular loading conditions can be determined by routine experimentation, augmented if necessary by numerical stress/strain modelling, e.g. finite element analysis.

Figure 8A:
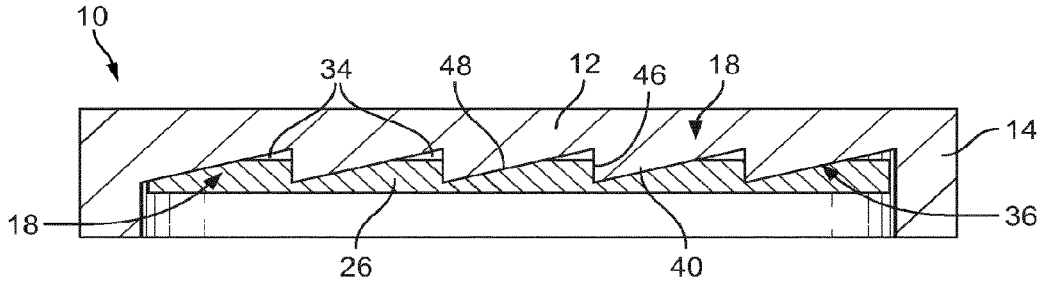
FIGS. 8*a*-8*f* are variants of FIG. 7, each with different annular area counterface profiles.
Figure 8B:
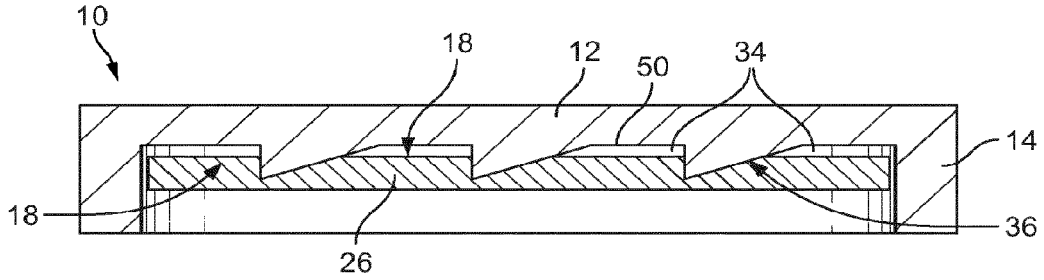
Figure 8C:
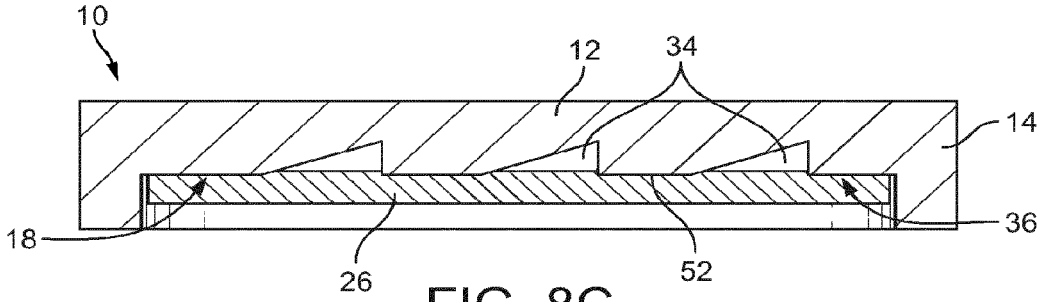
Figure 8D:
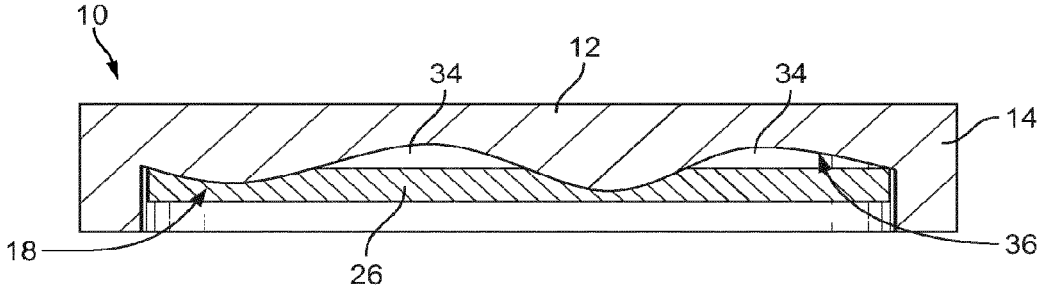
Figure 8E:
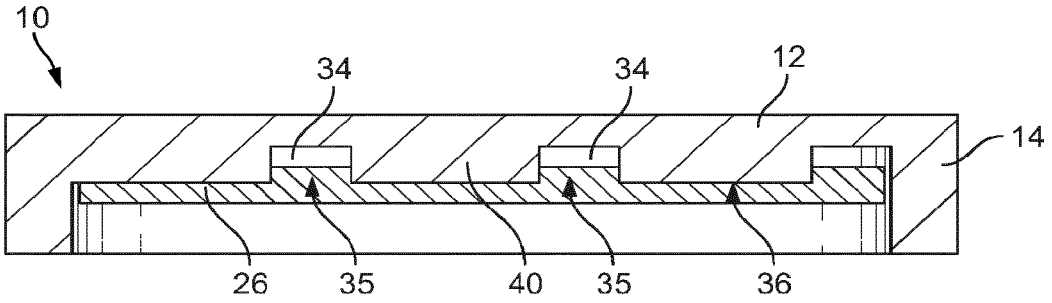
Figure 8F:
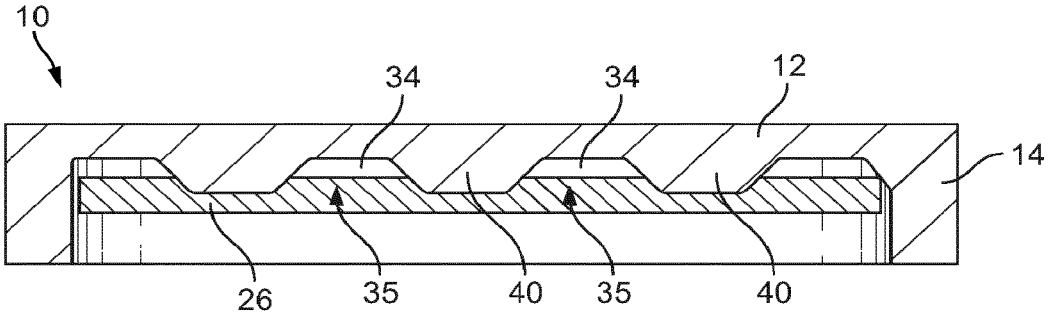

FIGS. 8*a*-8*f* are similar in principle to FIG. 7 in providing an uneven counterface 36 on the annular region 18, but very diagrammatically illustrate further possible counterface profiles. These are shown only by way of further example: many other profiles will also be effective in providing a gas pathway at the counterface; while acting to "energise" the sealing element sufficiently evenly at its face remote from the counterface, so as to generate a satisfactory liquid-tight seal around the rim of the container opening. FIG. 8*a* shows an asymmetric saw tooth profile with faces 46 extending generally normal to the plane of the sealing element 26, linked by angled faces 48. Through holes forming the gas pathways 34 through the annular region 18 are thus located at the internal angle formed between the faces 46, 48 where they are most deeply recessed within the closure 10. FIG. 8*b* is similar, except this internal angle is flattened to form a flat groove bottom 50. FIG. 8*c* is again similar, but here the tips of the teeth are flattened at 52. FIG. 8*d* shows a sinusoidal tooth profile. In all four cases, the gas pathways 34 are formed at the most deeply recessed parts of the counterface 36. The profile of the counterface used in the screw cap shown in FIGS. 1 and 4*b* essentially corresponds to that of FIG. 8*a*, but with the height/depth of the teeth being shown exaggerated in FIG. 8*a*. The gas pathways through the annular region 18 in FIG. 8*e* take the form of open, rectangular sectioned grooves separated by wider lands 40. In FIG. 8*f*, the grooves have sloping sides, so that the grooves 35 and lands 40 have a similar rhomboid cross-section.

Figure 9:
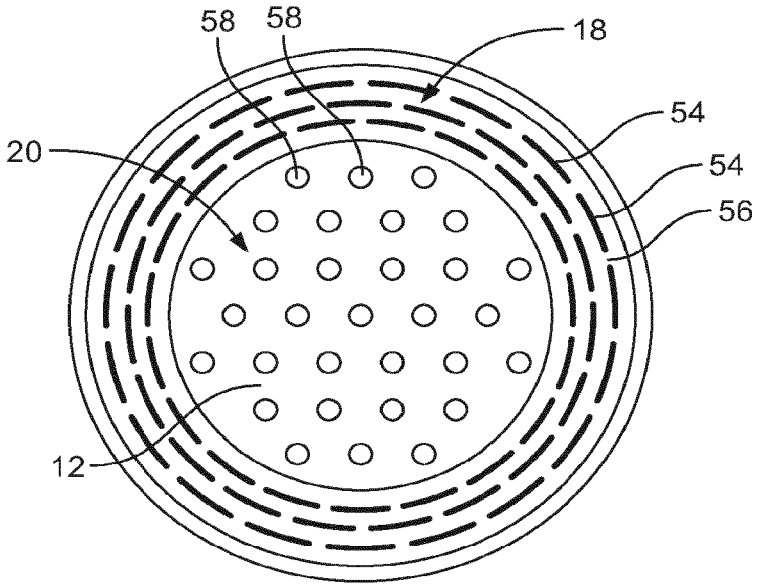
FIG. 9 is a diagrammatic plan view corresponding to FIG. 6, but showing a further embodiment.

FIG. 9 is a diagrammatic plan view of a closure top wall 12 as seen from the inside, including the annular region 18 and the interior space 20 which opposes the container opening, separated from that opening by the sealing element when fitted. The counterface of the annular region 18 comprises curved ridges 54 arranged to form concentric, interrupted, raised rings. The interruptions or gaps between the ends of neighbouring ridges 54 are staggered from one ring to the next, so as to produce a reticulated or labyrinthine through hole or network of through holes 56 which constitute the gas pathway. In an alternative arrangement the gaps in each ring may be aligned with the gaps in a neighbouring ring or rings, to provide a network of through holes which includes radial flow passages and circumferential interconnections. The closure top wall 12 in the interior space 20 comprises an array of protruding "pips" 58 which act as spacing supports for the sealing element, providing a reticulated venting gas flow area in the space 20. Many other forms of spacing supports will also be suitable, including curved ridges as described above with respect to the counterface 56 of FIG. 9.

Figure 10:
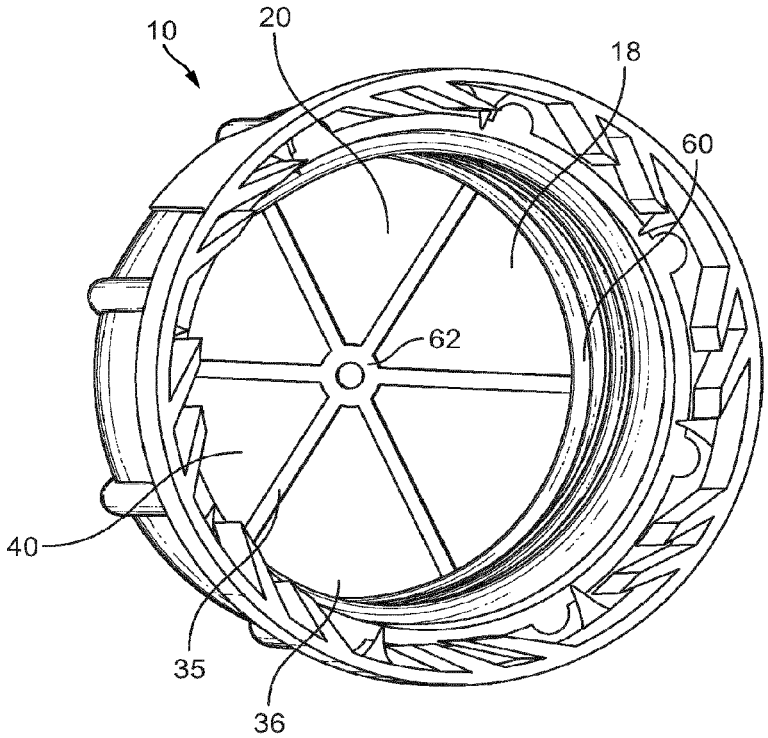
FIG. 10 is a perspective view of the interior of a container screw cap forming a still further embodiment.
Figure 11:
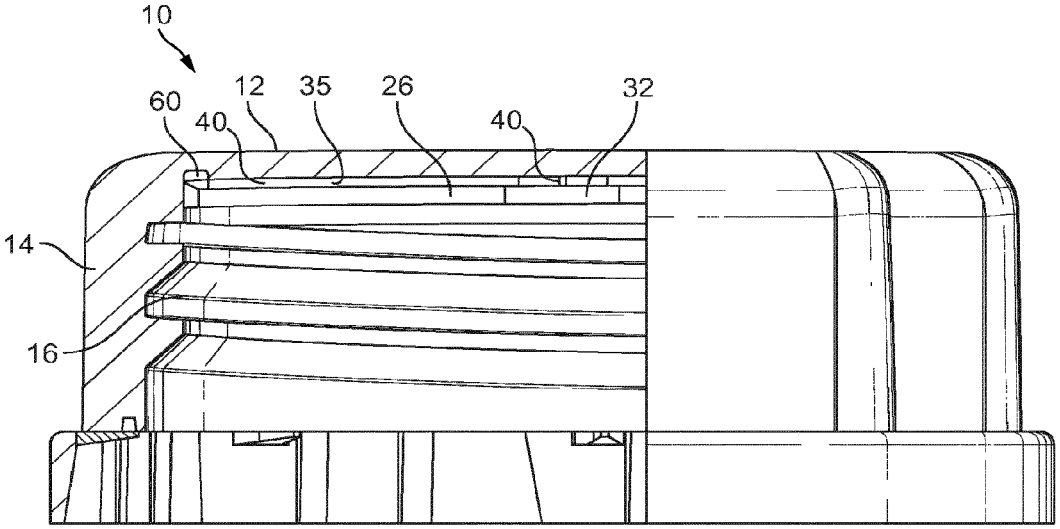
FIG. 11 is a partly cutaway side view of the cap of FIG. 10.

FIGS. 10 and 11 show a further screw cap embodiment of the invention. The inside face of the cap 10 top wall 12 is divided into six similar, sector shaped lands 40 by six open sectioned, radial grooves 35. Other numbers of these can also be used. The grooves and lands extend unbroken from the interior space 20 into the annular (seal element energising) region 18. Thus the space 20 and annular region 18 are undifferentiated from one another in terms of the pattern of the lands and grooves. Radially inward of the annular region 18 the lands form the sealing element spacing supports and the grooves form the interior space 20; whereas in the annular region 18 the lands form the sealing element energising counterface 36 and the grooves 35 form the gas pathways. The grooves may be of any suitable open cross-section, e.g. substantially rectangular or rhomboid as shown diagrammatically in FIGS. 8*e* and 8*f*; V- or U-shaped, semicircular, etc. Indeed, other forms of undifferentiated or substantially undifferentiated annular region 18 and central space 20 will be readily apparent. For example the pattern of "pips" 58 as shown in FIG. 9 could extend throughout the inner face of the cap top wall 12. Alternatively, the ridges 54 (or some other, differently shaped, projections) could extend across the whole of this inner face. In each case the projections must be such as to allow gas flow between them across the inner face, between an edge of the inner face and a position corresponding to the gas permeable region (e.g. hole 32) in the sealing element 26. The projections should provide adequate support to the sealing element 26 over the central space 20 to permit such gas flow (and preferably also to resist bursting of the sealing element when the container is overpressurised, e.g. when knocked or dropped). The projections should also compress and energize the sealing element 26 sufficiently non-uniformly in the annular region 18 to permit such gas flow along the immediately adjacent face of the sealing element, but at the same time providing sufficiently uniform compression and energisation of the peripheral part of the sealing element to provide a liquid-tight seal at the opposite (container opening rim contacting) sealing element face. The packing density of the projections may vary across the top wall 12 inner face to meet these various requirements.

In the cap shown in FIGS. 10 and 11, the inner ends of the grooves 35 terminate in a circular gallery or depression 62 at the centre of the cap top wall 12 (or at another location corresponding to where the sealing element is gas-permeable, if applicable). The gallery 62 interconnects the grooves 35 and ensures that they are all in gas communication with the hole 32 when the sealing element 26 is secured in place within the cap 10, supported on the lands 40. The outer ends of the grooves 35 are interconnected by an open sided groove 60 forming a circular gallery at the junction between the cap top and side walls 12, 14. Gas flowing to or from any of the grooves 35 may thus be conducted to or from any point(s) around the cap circumference where a suitable gap exists between the outer edge of the sealing element and the adjacent cap side wall 12 for gas to flow to/from the grooves 35, to/from the container threads and cap threads 16.

Screw Cap Moulding Considerations

Where the container closure is a moulded screw cap provided with internal threads which are too coarse to allow the cap to be "popped off" a mould core, either a collapsible mould core must be used, or provision must be made for screwing the mould core out of the cap.

When using a collapsible core, the corresponding radially outer region on the inner face of the cap top wall cannot have substantial three dimensional features or patterning which presents surfaces extending transversely to the direction of movement of the elements of the mould core as they collapse. Generally the collapsible elements of the core are each of fixed width and each collapse along a different radial direction of the cap. Such collapsible cores usually have a central rod having an end face which forms part of the mould surface and which is withdrawable from the remainder of the core to allow the surrounding, leaf spring mounted, collapsible elements of the core to move inwards. This end face therefore moves in a direction normal to the cap end wall 12. Corresponding features towards the centre of the inner surface of the cap end face therefore can have any shape in the plane of that surface, but should not present undercuts in a normal direction extending away from that plane (i.e. in the withdrawal direction of the core central rod). Such a collapsible core configuration is therefore suitable for moulding annular regions 18 as shown for example in FIGS. 6*a*, 6*b*, 6*c*, 7 and 8*a*-8*f*, in conjunction with central spaces 20 as shown for example in FIGS. 1 and 10.

Figure 11A:
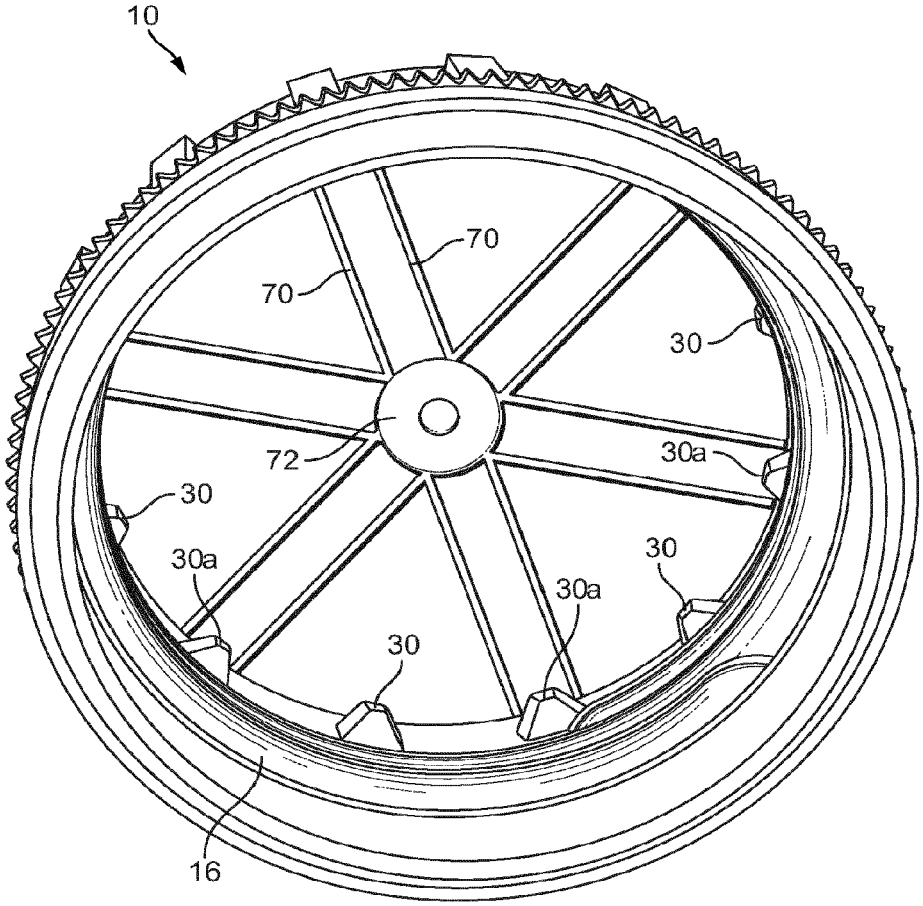
FIGS. 11*a* and 11*b* show a further screw cap embodying the invention and a collapsible core mould used to form the cap.
Figure 11B:
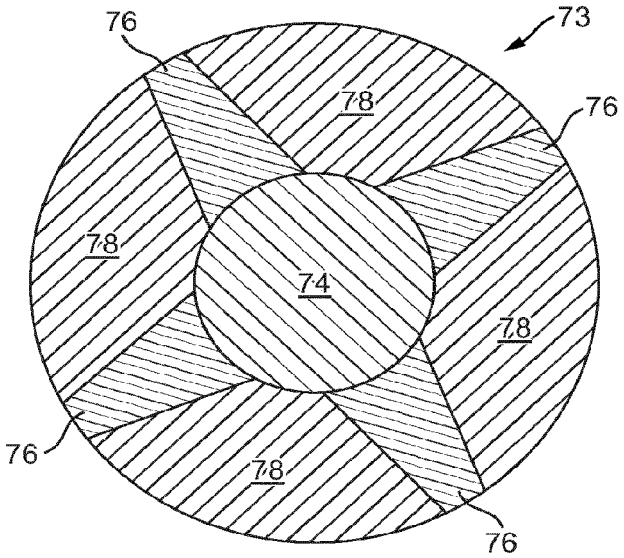

The cap in FIG. 11*a* requires a collapsible mould core 73, as shown in diagrammatic axial cross-section in FIG. 11*b*, to form the coarse internal thread 16 and undercut wad retaining protuberances 30, 30*a*. Collapse and withdrawal of the mould core occurs as follows. A first core element is a central rod 74 whose end face is shaped to form a centre annular depression 72 in the cap top inner surface and preferably also the adjacent inner portions of parallel grooves 70. Radially outwardly tapering core elements 76 form the remainder of the parallel grooves 70, the protuberances 30*a* and the thread portions at the corresponding circumferential locations. Elements 76 are inwardly resiliently biased against the first core element 74 by being mounted at the ends of axial leaf springs (not shown). Core elements 78 fill the gaps between the elements 76 for moulding the remainder of the cap top inner surface, the protuberances 30 and circumferentially corresponding thread portions. The elements 78 are similarly mounted and biased. When it is desired to remove the core 73 from within the newly moulded cap, the first core element 74 is axially withdrawn. This allows the elements 76, 78 to collapse radially inwardly, the elements 76 moving further inward than the elements 78, due to the wedging action of elements 78 on the outwardly tapering cross-section of the elements 76. Elements 76 are free to move radially inward along the parallel grooves 70. The radially inward movement of the elements 76, 78 allows their radially outer faces to move clear of the undercut protuberances 30, 30*a* and the cap internal thread. The elements 76, 78 can then be axially withdrawn from the cap. Alternatively, elements 78 may be used to mould the protuberances 30*a* and grooves 70, with the elements 76 used to form the protuberances 30. Note the seal energising area is undifferentiated from the gas flow area of the cap top inner surface in the cap design shown in FIG. 11*a*.

A core which can be screwed out of the cap can comprise a central rod somewhat as described above for a collapsible core but, instead of collapsible elements, is surrounded by a sleeve which can simultaneously be rotated and withdrawn along the length of the rod, to free the cap internal threads. In such an arrangement, any 3-D features in the radially outer region on the inner face of the cap top wall corresponding to the sleeve cannot present any "leading" surfaces extending normal to the circumferential unscrewing direction. Also their surface slopes in the unscrewing direction cannot be greater than the slope of the thread, or else the sleeve will not be able to slide over or lift away from the 3-D features as it is unscrewed. Provided that their slopes meet this condition, the annular areas shown in FIGS. 1, 4*b* and 8*a*-8*d* can all be made using such a mould core with unscrewable sleeve. The cap shown in FIG. 10 has radial grooves 35 whose outer ends correspond to and will be formed by the core sleeve. Therefore with a standard right hand thread, the "anticlockwise" sides of the groove outer ends ideally should have slopes which are no greater than the slope of the screw thread 16, if the cap is to be moulded using such a core. A multi-start thread has a greater slope than a single start thread and therefore allows greater design freedom.

Sealing Element Construction

Figure 12:
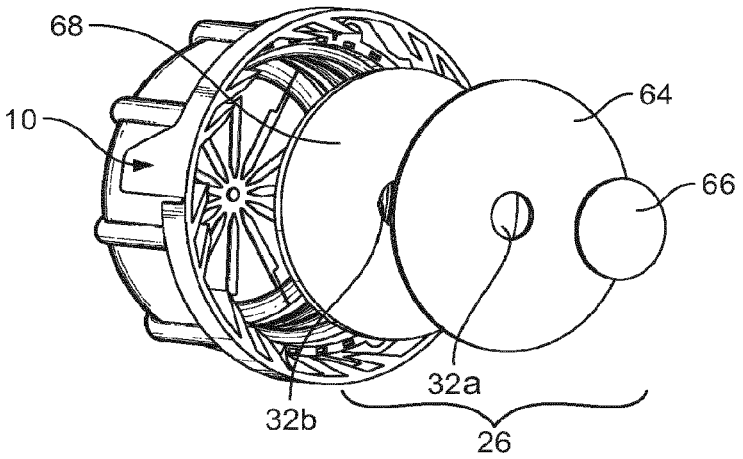
FIGS. 12-14 show vented container caps embodying the invention and having wad insert assemblies which provide for foil sealing.

The cap 10 shown in FIG. 12 is the same as that shown in FIG. 1, but in FIG. 12 the sealing element 26 has a different multi-part construction shown there in exploded view. The sealing element 26 comprises a tear open part formed by a metal or metallised foil disc 64. A smaller disc of gas permeable, liquid impermeable material 66 is secured over a central hole 32*a* in the foil disc 64, e.g. by fusion bonding or by a continuous ring of adhesive around the hole and between the mating faces of the two discs. The sealing element comprises a further part formed by a compressible wad or disc 68. A hole 32*b* is provided in the wad 68, for alignment and gas communication with the hole 32*a*. In use, both the wad 68 and foil 64 are fitted into the cap 10 and retained by the groove 24 or undercut protuberances 30, or by gluing or welding, as described above in relation to FIGS. 1 and 3. To provide a unitary assembly which is more convenient to handle, prior to their installation in a cap 10, the sealing element parts 66 and 68 can be connected (e.g. glued) together. Such sealing element assemblies 26 can be supplied to customers on their own, as well as pre-installed in caps 10 or other similar closures.

The cap 10 with the sealing element assembly 26 installed can then be applied to a container neck at a filling line. Here after application of the cap the foil can be induction heated in the conventional way to weld it to the rim of the container neck and form a tear-open, tamper indicating, liquid seal. The disc 66, holes 32*a*, 32*b* cap/container threads and the above-described structure on the inner face of the cap top wall additionally provide gas venting to the container contents.

The breaking force for any connection between the parts 64, 68 is preferably less than the pulling force required to remove the wad 68 from the cap 10 and less than the force required to tear the foil 64 from the container neck. Thus when a user unscrews the cap 10 for the first time, the connection between the foil 64 and wad 68 is broken, with the wad remaining in the cap as it is removed, and the foil seal 64 remaining intact but being exposed for rupture/removal, to allow access to the container contents. The foil disc may have a slightly smaller diameter than the wad, so that only the latter is directly trapped by the cap peripheral grove 24 or protuberances 30.

Figure 13:
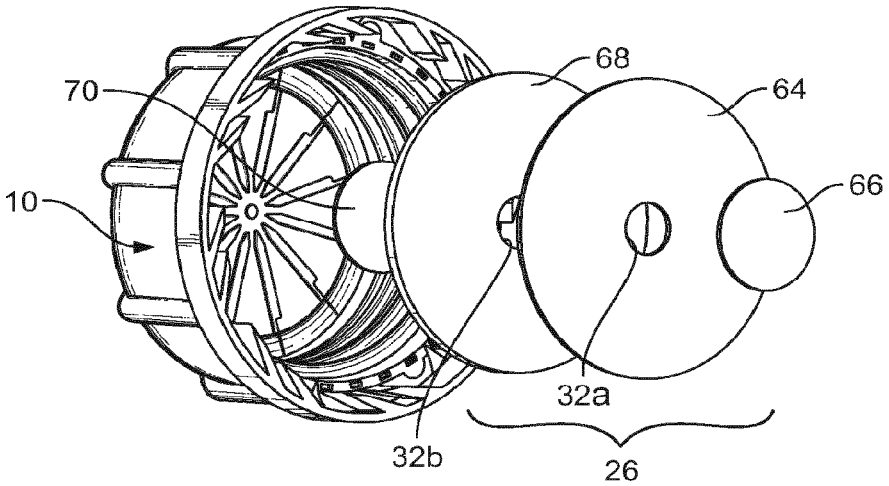

Once the foil 64 has been breached, the cap 10 may no longer be able to provide a complete liquid seal when reapplied to the container, due to the hole 32*b* in the wad 68. However, the relatively narrow gas passageways within the cap, in particular through the annular region 18, may provide an adequate liquid seal in many cases. Where a better liquid re-sealing capability is needed after the foil has been breached, the arrangement shown in FIG. 13 can be used. This is similar to FIG. 12, except that a gas permeable, liquid impermeable disc is secured over the opening 32*b* in the wad 68, in the same way as the disc 66 is secured over the aperture in the foil 64. When the foil 64 has been breached, the wad 68 and disc 70 will function in the same way as the seal 26 of FIG. 2, to provide gas venting, liquid sealing re-closure of the container to which the cap is applied.

Figure 14:
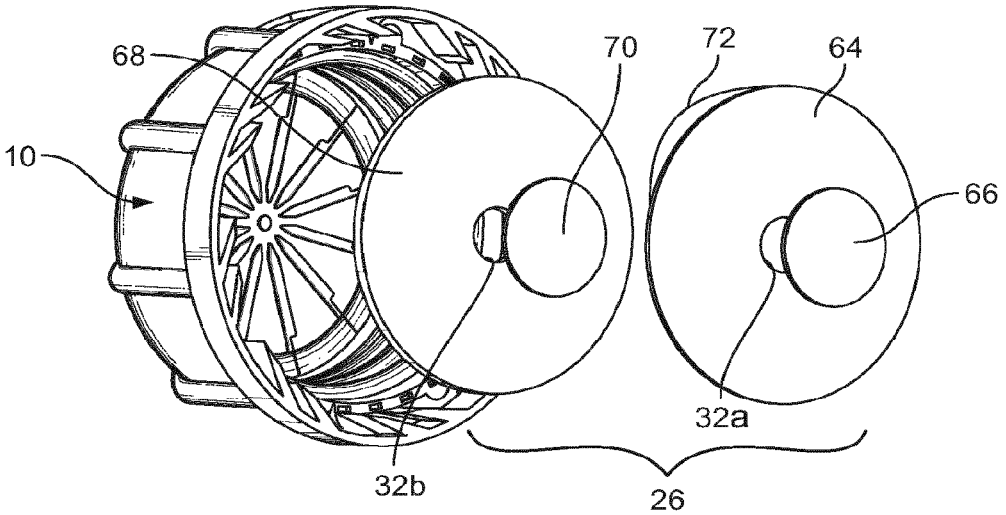

FIG. 14 shows a further modification, in which the foil 64 is provided with an "Easy-Peel"® type tab 72. This takes the form of a disc of strong plastics film which is fused to the foil disc 64 over a semicircular area. The two discs are separable over the remaining semicircular region, so that the free semicircular part of the plastics disc 72 may be folded out to stand up from the foil disc 64. This forms a semicircular tab graspable between finger and thumb, by which the foil 64 can be easily torn or peeled from the container neck rim. The hole 32*a* passes through disc 72 as well as through foil disc 64.

The disc 66 may be applied to either of the sides of disc 64. Similarly the disc 70 may be applied to either of the sides of the wad 68 (compare FIGS. 13 and 14). Indeed, both the wad 68 and the foil 66 may be multi-layered laminated structures, with the discs 66, 70 secured adjacent any suitable layer. For example, the disc 66 may be incorporated between layers 64 and 72 in a sealing element structure 26 otherwise similar to that of FIG. 14.

The sealing element assembly 26 may be replaced by a standard, plain, sealing wad (not shown), without a hole 32*b*. This will function entirely normally in the cap 10, despite the special gas venting features provided inside the cap top wall 12; to produce a non-gas venting, liquid sealing closure. Thus the cap 10 can be standardised throughout a closure manufacturer's product range, merely being fitted with a "special" gas-permeable, liquid impermeable sealing element 26 for gas venting applications, and being fitted with a standard sealing wad where no gas venting capability is needed. This reduces parts inventory, and the amount of manufacturing equipment needed.

Many further variations and modifications to the particularly described embodiments will be readily apparent. For example, features particularly described in relation to one embodiment may be omitted, or may be used in, or substituted for features described in relation to, other embodiments, where such omission, use or substitution is technically possible; all within the scope of the claims. Throughout this specification, the term "gas" includes vapour. As used in this specification, the term "foil" includes thin sheets made from any appropriate material, including not only metals, but also for example plastics, paper, or paper-based materials, or combinations of any of these, whether as laminates, compounds or as other combinations.

What is claimed is:

1. A container closure, comprising:

a top wall having an exterior surface and an interior surface, the top wall comprising, at the interior surface, an annular part forming a counterface;

a side wall axially extending from a base at the top wall interior surface;

a sealing element having a top surface, a bottom surface and a peripheral edge, the sealing element having a portion that is gas permeable and liquid impermeable;

a central interior space above the sealing element, defined between the top wall interior surface and the sealing element top surface and surrounded by the counterface; and a series of hollows, wherein each hollow extends linearly in the annular part of the top wall from the central interior space to the base of the side wall, wherein the sealing element is configured to overlap with the counterface, the sealing element sealing a rim of a container opening and being urged into engagement with said rim by said counterface when the container closure is secured to the container opening, wherein a gas pathway is formed through the series of hollows, the gas pathway being in gas communication between the central interior space and a space defined between said side wall and said peripheral edge of the sealing element, wherein each hollow comprises a respective open-sided groove provided in the counterface, and wherein a profile of the counterface is wave shaped in a cross-section that extends circumferentially from the counterface and parallel to the side wall.

2. The container closure of claim 1, wherein a transverse cross-section of the gas pathway comprises a closed boundary and extends through the annular part.

3. The container closure of claim 1, wherein the central interior space of the container closure comprises one or more spacing supports which support the sealing element spaced from the interior surface.

4. The container closure of claim 1, wherein the annular part is provided at or towards an outer edge of the top wall.

5. The container closure of claim 1, wherein the sealing element is secured inside the container closure to cover the annular part and the central interior space.

6. The container closure of claim 5, wherein the side wall comprises a peripheral groove into which the sealing element is clipped.

7. The container closure of claim 5, wherein the side wall comprises a series of undercut protuberances forming notches into which an outer edge of the sealing element is clipped.

8. The container closure of claim 1, wherein the sealing element comprises:

a sealing foil of predetermined shape, wherein the sealing foil is gas permeable and liquid impermeable, and wherein the sealing foil is configured to bond about a periphery of a container rim of corresponding shape.

9. The container closure of claim 8, wherein the sealing element further comprises an aperture over which a gas-permeable, liquid impermeable layer is secured.

10. The container closure of claim 8, wherein the sealing element comprises a further part which remains in the container closure when the sealing foil has been ruptured or removed.

11. The container closure of claim 10, wherein the further part is connected to the container closure in use and the sealing foil is secured to the further part by a breakable connection prior to removal of the container closure.

12. The container closure of claim 10, wherein the further part is gas-permeable and liquid impermeable and is arranged in the container closure to be in gas communication with the sealing foil prior to its removal.

13. A container closure, comprising:

a top wall having an exterior surface and an interior surface, the top wall comprising, at the interior surface, an annular part forming a counterface;

a side wall axially extending from a base at the top wall interior surface;

a sealing element having a top surface, a bottom surface and a peripheral edge, the sealing element having a portion that is gas permeable and liquid impermeable;

a central interior space above the sealing element, defined between the top wall interior surface and the sealing element top surface and surrounded by the counterface; and a series of hollows, wherein each hollow extends linearly in the annular part of the top wall from the central interior space to the base of the side wall, wherein the sealing element is configured to overlap with the counterface, the sealing element sealing a rim of a container opening and being urged into engagement with said rim by said counterface when the container closure is secured to the container opening, wherein a gas pathway is formed through the series of hollows, the gas pathway being in gas communication between the central interior space and a space defined between said side wall and said peripheral edge of the sealing element, wherein each hollow comprises a respective open-sided groove provided in the counterface, wherein a profile of the counterface is saw-toothed in a cross-section that extends circumferentially from the counterface and parallel to the side wall, and wherein the saw-toothed profile of the counterface comprises flattened teeth tip regions.

14. The container closure of claim 13, wherein the central interior space of the container closure comprises one or more spacing supports which support the sealing element spaced from the interior surface.

15. The container closure of claim 13, wherein the annular part is provided at or towards an outer edge of the top wall.

16. The container closure of claim 13, wherein the sealing element is secured inside the container closure to cover the annular part and the central interior space.

17. The container closure of claim 16, wherein the side wall comprises a peripheral groove into which the sealing element is clipped.

18. The container closure of claim 16, wherein the side wall comprises a series of undercut protuberances forming notches into which an outer edge of the sealing element is clipped.

19. The container closure of claim 13, wherein the sealing element comprises:

a sealing foil of predetermined shape, wherein the sealing foil is gas permeable and liquid impermeable, and wherein the sealing foil is configured to bond about a periphery of a container rim of corresponding shape.

20. The container closure of claim 19, wherein the sealing element further comprises an aperture over which a gas-permeable, liquid impermeable layer is secured.

21. The container closure of claim 19, wherein the sealing element comprises a further part which remains in the container closure when the sealing foil has been ruptured or removed.

22. The container closure of claim 21, wherein the further part is connected to the container closure in use and the sealing foil is secured to the further part by a breakable connection prior to removal of the container closure.

23. The container closure of claim 21, wherein the further part is gas-permeable and liquid impermeable and is arranged in the container closure to be in gas communication with the sealing foil prior to its removal.

24. A container closure, comprising:

a top wall having an exterior surface and an interior surface, the top wall comprising, at the interior surface, an annular part forming a counterface;

a side wall axially extending from a base at the top wall interior surface;

a sealing element having a top surface, a bottom surface and a peripheral edge, the sealing element having a portion that is gas permeable and liquid impermeable;

a central interior space above the sealing element, defined between the top wall interior surface and the sealing element top surface and surrounded by the counterface; and a series of hollows, wherein each hollow extends linearly in the annular part of the top wall from the central interior space to the base of the side wall, wherein the sealing element is configured to overlap with the counterface, the sealing element sealing a rim of a container opening and being urged into engagement with said rim by said counterface when the container closure is secured to the container opening, wherein a gas pathway is formed through the series of hollows, the gas pathway being in gas communication between the central interior space and a space defined between said side wall and said peripheral edge of the sealing element, wherein each hollow comprises a respective open-sided groove provided in the counterface, wherein a profile of the counterface is saw-toothed in a cross-section that extends circumferentially from the counterface and parallel to the side wall, and wherein the saw-toothed profile comprises hollows between teeth of the saw-toothed profile, the hollows comprising flattened bases.

25. The container closure of claim 24, wherein the central interior space of the container closure comprises one or more spacing supports which support the sealing element spaced from the interior surface.

26. The container closure of claim 24, wherein the annular part is provided at or towards an outer edge of the top wall.

27. The container closure of claim 24, wherein the sealing element is secured inside the container closure to cover the annular part and the central interior space.

28. The container closure of claim 27, wherein the side wall comprises a peripheral groove into which the sealing element is clipped.

29. The container closure of claim 27, wherein the side wall comprises a series of undercut protuberances forming notches into which an outer edge of the sealing element is clipped.

30. The container closure of claim 24, wherein the sealing element comprises:

a sealing foil of predetermined shape, wherein the sealing foil is gas permeable and liquid impermeable, and wherein the sealing foil is configured to bond about a periphery of a container rim of corresponding shape.

31. The container closure of claim 30, wherein the sealing element further comprises an aperture over which a gas-permeable, liquid impermeable layer is secured.

32. The container closure of claim 30, wherein the sealing element comprises a further part which remains in the container closure when the sealing foil has been ruptured or removed.

33. The container closure of claim 32, wherein the further part is connected to the container closure in use and the sealing foil is secured to the further part by a breakable connection prior to removal of the container closure.

34. The container closure of claim 32, wherein the further part is gas-permeable and liquid impermeable and is arranged in the container closure to be in gas communication with the sealing foil prior to its removal.

* * * * *